United States Patent [19]

Eckstein et al.

[11] Patent Number: 5,054,070

[45] Date of Patent: Oct. 1, 1991

[54] STEREO SIGNAL COMMUNICATION SYSTEM AND METHOD

[75] Inventors: Eric A. Eckstein, Narberth, Pa.; Charles H. Haubrich, Williamstown, N.J.

[73] Assignee: QEI Corporation, Williamstown, N.J.

[21] Appl. No.: 488,904

[22] Filed: Mar. 5, 1990

[51] Int. Cl.[5] ..... H04H 5/00

[52] U.S. Cl. ..... 381/7; 381/14; 381/4

[58] Field of Search ..... 381/7, 14, 2, 3, 4

[56] References Cited

U.S. PATENT DOCUMENTS

| | | | |
|---|---|---|---|
| 3,040,132 | 6/1962 | Wilhelm | 370/77 |
| 3,789,323 | 1/1974 | Andersen et al. | 381/7 |
| 3,902,019 | 8/1975 | Bruene | 455/113 |
| 4,194,161 | 3/1980 | Hershberger | 381/7 |
| 4,688,253 | 8/1987 | Gumm | 381/7 |
| 4,723,288 | 2/1988 | Borth et al. | 381/7 |
| 4,757,538 | 7/1988 | Zink | 381/7 |

*Primary Examiner*—Forester W. Isen
*Attorney, Agent, or Firm*—Albert L. Free

[57] ABSTRACT

A system which enables transmission of a standard composite stereo sound signal, made up of baseband, subcarrier band and pilot signals, from a first location to a second location while requiring only a relatively low bit rate for the transmission link. The standard composite stereo signal is synchronously sampled at a first location at rate $F_s$ twice the subcarrier frequency $F_c$ (four times the pilot frequency $F_p$), and the sampled signal transmitted over the link along with appropriate synchronizing signals. At the second location, a signal processor separates the received signal into a first signal related to one stereo channel signal (e.g. R) and a second signal representative of the other stereo channel (e.g. L), determines the proper scale for the pilot signal, and regenerates the original standard composite stereo sound signal by combining the L-related and R-related signals with the pilot scale signals in appropriate proportions and with appropriate filtering. Bit interpolation techniques are preferably employed at the second station to facilitate the necessary filtering.

13 Claims, 8 Drawing Sheets

$$C(t)=L(t)+R(t)+A\ SIN(2\pi F_p t)+\ SIN(2\pi F_c t)[L(t)-R(t)]$$

100%
10%
(Fp) 19 KHz PILOT CARRIER
(2Fp) Fc
(3Fp) 57 KHz
(4Fp) Fs 76 KHz
(5Fp) 95 KHz
(6Fp) 114 KHz
(7Fp) 133 KHz
(8Fp) 152 KHz
L + R (0-15)
53
23
L - R (23-53)
L + R (61-91)
L - R (99-129)
L + R (137-167)
0 10 20 30 40 50 60 70 80 90 100 110 120 130 140 150 160 KHz

AFTER DIGITAL FILTER
REJECT
PASS
PASS
L-R
0 Fp 2Fp 3Fp 4Fp 5Fp 6Fp 7Fp 8Fp 9Fp 10Fp 11Fp 12Fp 13Fp 14Fp 15Fp 16Fp 17Fp 18Fp
15 99 152 205 323 342
KHz

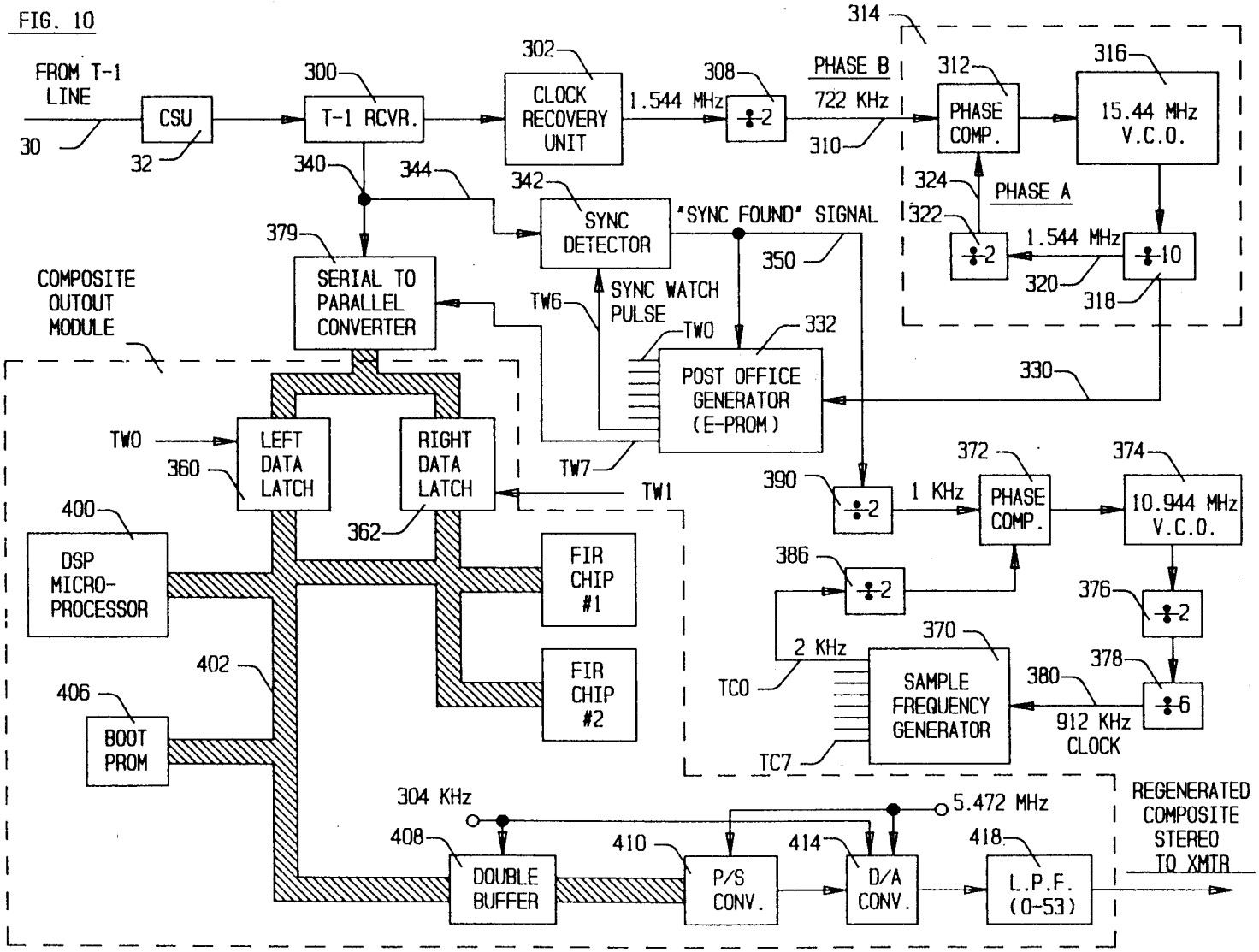
FIG. 10
FROM T-1 LINE
30
CSU
32
T-1 RCVR.
300
340
CLOCK RECOVERY UNIT
302
1.544 MHz
308
÷2
PHASE B
722 KHz
310
PHASE COMP.
312
314
15.44 MHz V.C.O.
316
÷10
318
1.544 MHz
320
PHASE A
÷2
322
324
330
"SYNC FOUND" SIGNAL
350
332
SYNC DETECTOR
342
SYNC WATCH PULSE
TW6
TW0
POST OFFICE GENERATOR (E-PROM)
TW7
TW1
344
SERIAL TO PARALLEL CONVERTER
379
COMPOSITE OUTPUT MODULE
RIGHT DATA LATCH
362
LEFT DATA LATCH
360
TW0
FIR CHIP #1
FIR CHIP #2
DSP MICRO-PROCESSOR
400
402
BOOT PROM
406
÷2
390
1 KHz
PHASE COMP.
372
10.944 MHz V.C.O.
374
÷2
376
÷6
378
912 KHz CLOCK
380
÷2
386
2 KHz
TC0
SAMPLE FREQUENCY GENERATOR
370
TC7
5.472 MHz
304 KHz
DOUBLE BUFFER
408
P/S CONV.
410
D/A CONV.
414
L.P.F. (0-53)
418
REGENERATED COMPOSITE STEREO TO XMTR

STEREO SIGNAL COMMUNICATION SYSTEM AND METHOD

FIELD OF THE INVENTION

This invention relates to systems and methods for the translation or communication of standard stereophonic sound signals from one location to another, by way of a communications link.

BACKGROUND OF THE INVENTION

In the field of stereo sound transmission systems, it is often desirable to be able to translate or communicate a standard composite stereophonic sound signal from one location to another through a link which is limited as to the rate at which it can pass information. Such a standard composite stereophonic sound signal typically comprises, for example, a low-frequency band representing the sum L+R of the Left and Right channel signals, a pilot carrier at a frequency $F_p$ above the L+R signal band, and a suppressed-carrier double-sideband signal at frequencies above the pilot carrier and in which the sideband modulation represents the difference L−R between the Left and Right signal channels; conventionally, the suppressed carrier is at a frequency equal to twice the pilot carrier frequency. Typically for FM stereo radio, the L+R signal is in a near-zero to 15 KHz band, the pilot carrier is at 19 KHz, and the subcarrier signal occupies a band of 38 KHz plus and minus 15 KHz. For conventional U.S. television stereo sound, the pilot frequency $F_p$ is 15.734 KHz and the subcarrier frequency is 31.468 KHz.

As an example, the stereo sound may originate at a studio or other location distant from the actual broadcast transmitter. In such cases, it is desirable and usual practice to form the standard composite stereophonic sound signal at the remote location and send it, as a whole, to the broadcast transmitter location. While it is possible, instead, to send each stereo channel separately over its own telephone line, very substantial technical problems have been encountered in doing this, primarily because of difficulties in maintaining the desired proper relationship between the two signals when separately translated over different telephone lines and recombined at the broadcast transmitter.

In order to be able to transmit a full standard composite stereo sound signal faithfully through the link to the broadcast transmitter, it has been common to employ microwave transmission rather than telephone lines, but such microwave systems are not always readily available, and are relatively expensive in any event.

It is possible to sample and digitize the entire standard stereo composite signal and send it over a communication line, if the line is able to accommodate a sufficiently high bit rate. However, the standard stereo composite signal itself occupies about 53 KHz, and to sample and encode it appropriately by prior-art methods would require more than 106,000 samples per second; if each such sample is digitized into say 16 bits, the minimum required bit rate would be $1.69\times10^6$ bits per second. In a practical system, an even larger bit rate, e.g. $2\times10^6$ per second, would typically be required. However, the relatively inexpensive, standard telephone line pair, the so-called T-1 line, and the telephone switching and relaying equipment with which it commonly operates, cannot accept and handle properly more than $1.544\times10^6$ bits per second. Even if only 14 bits per sample were used, the theoretical minimum bit rate required by standard prior art procedures would be 1.484 megabits per second, which as a practical matter is too close to the 1.544 megabits per second limit of operation for a T-1 line. Even if the line used stereo transmissions, it is desirable in general to be able to transmit the signals at the lowest possible bit rate.

Accordingly, it is an object of the present invention to provide a new and useful system and method for transferring a standard composite stereophonic sound signal over a link having a relatively low maximum permissible bit transmission rate, such as a standard T-1 telephone line.

Another object is to provide such system and method which provide the desired reproduced sound fidelity, yet are relatively inexpensive, compact and easy to use.

A still further object is to provide such system and method which accomplish the above-described objectives using a special type of digitizing and encoding of the stereo composite signal at the first station, and a corresponding special inverse system at the receiving station, which is typically an FM radio or television broadcasting station.

SUMMARY OF THE INVENTION

These and other objects and features of the invention are achieved by the provision of a system in which the standard composite stereo sound signal is sampled at a frequency $F_s$ which is twice the subcarrier frequency $F_c$ of the composite signal, and at phases for which the subcarrier represents the original two stereo channel signals, here designated as Left and Right signals for convenience. This sampling at $F_s$ is done by a sampling signal locked in phase and frequency synchronism with the pilot carrier of frequency $F_p$. The usual subcarrier frequency for FM stereo radio is 38 KHz, and the sampling frequency $F_s$ in this case is then preferably 76 KHz, with the samples taken at the positive and negative peaks of the subcarrier, i.e. at 45°, 135°, 225° and 315° of the pilot carrier. In other cases, as in television stereo sound, the subcarrier frequency may be different from 38 KHz, but the sampling frequency is still twice the subcarrier frequency; for example, in TV stereo sound the subcarrier frequency is 31.468 KHz, so that the sampling provided by the present invention for that case is 62.937 KHz.

The sampled composite signal is digitized and encoded in digital form for application to a relatively low bit-rate link, such as a T-1 telephone line, along with certain frame-defining synchronizing signals. At the other end of the line, the line signal is decoded and the pilot carrier, the synchronizing signals, a bit-rate clock signal and the stereo-representing data signals are derived. Using these signals, the received data signals are specially processed, and the (L+R), (L−R) and pilot signals recombined so that, after subsequent application to a digital-to-analog converter, they are in condition, with appropriate filtering, for supply to the broadcast transmitter as a reconstituted composite stereo sound signal.

Using the invention, the bit-rate required in the link between the remote station and the broadcast station is sufficiently low that the composite signal can be successfully transmitted through a T-1 telephone line. So far as applicants are aware, it has not heretofore been considered possible to transmit such a signal successfully through a T-1 line, and to obtain the resultant marked practical advantages in convenience and economy.

BRIEF DESCRIPTION OF FIGURES

These and other objects and features of the invention will be more readily understood from a consideration of the following detailed description, taken with the accompanying drawings, in which:

FIG. 10 is a block diagram showing in detail a transmitter CAT-Link constructed according to the invention.

DETAILED DESCRIPTION OF SPECIFIC EMBODIMENTS

Figure 1:
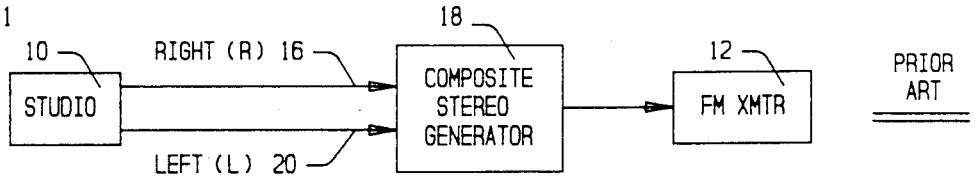
FIG. 1 is a block diagram illustrating one prior-art system for translating a composite stereo signal from studio to transmitter.

Referring to the specific embodiment shown in the drawings, and without thereby in any way limiting the scope of the invention, FIG. 1 shows one known form of apparatus for transferring or translating a signal from a studio 10 to a remote FM transmitter 12. One stereo signal (i.e. the Right channel signal designated R) is sent over a standard telephone line 16 to a composite stereo generator 18 at the FM transmitter; the other stereo signal (the Left signal, designated L) is separately transmitted over its own telephone line 20 to composite stereo generator 18. The latter generator responds to the L and R signals to generate the standard composite stereo signal at the transmitter location, and to apply it to the transmitter. As mentioned above, this has known drawbacks which make the system very undesirable in practice.

Figure 2:
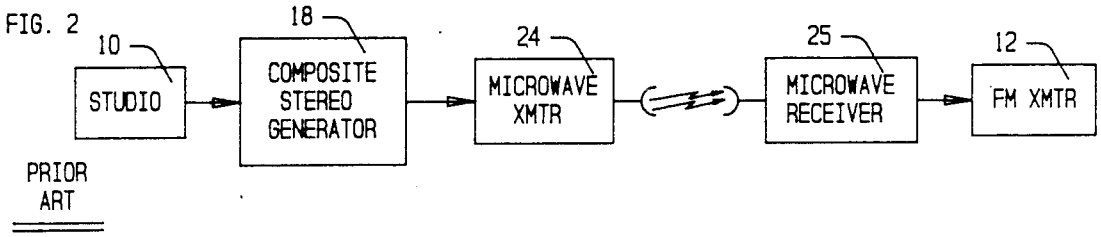
FIG. 2 is a block diagram illustrating another prior-art system for translating such a signal from studio to transmitter.

FIG. 2 shows, in accordance with the prior art, a similar studio 10 and remote FM transmitter 12, but in this case the composite stereo generator 18 is at the studio location, and the composite stereo signal is applied to a microwave transmitter 24 for space transmission to a microwave receiver 26 at the FM transmitter location, for detection and application to the latter transmitter. This conventional system operates well, but requires the microwave transmitter and receiver, the two microwave antennae, and a clear line-of-sight between the antennas, as well as path availability.

Figure 3:
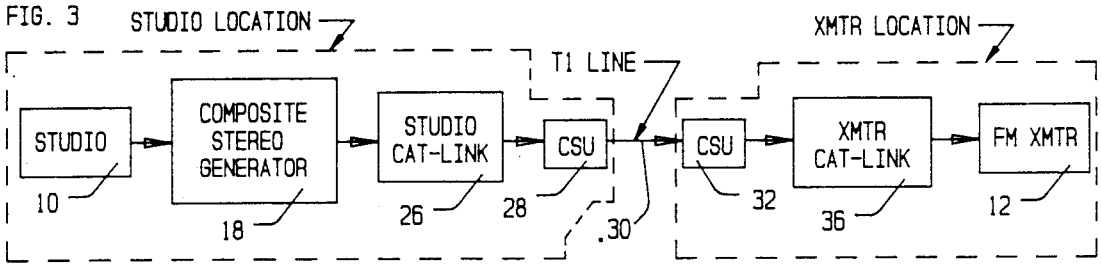
FIG. 3 is a block diagram illustrating the disposition of the main elements of this invention in a system for translating standard composite stereo from a studio to a transmitter.

FIG. 3 shows a general arrangement according to this invention. The composite stereo generator 18 is at the studio location, and the composite stereo signal is transferred from studio 10 to remote FM transmitter 12 by way of a studio CAT-Link 26, a standard CSU unit 28, a T-1 telephone line 30, a standard CSU 32 and a transmitter CAT-Link 36. The two CAT-Links contain apparatus in accordance with the invention as described below herein.

Figure 4A:
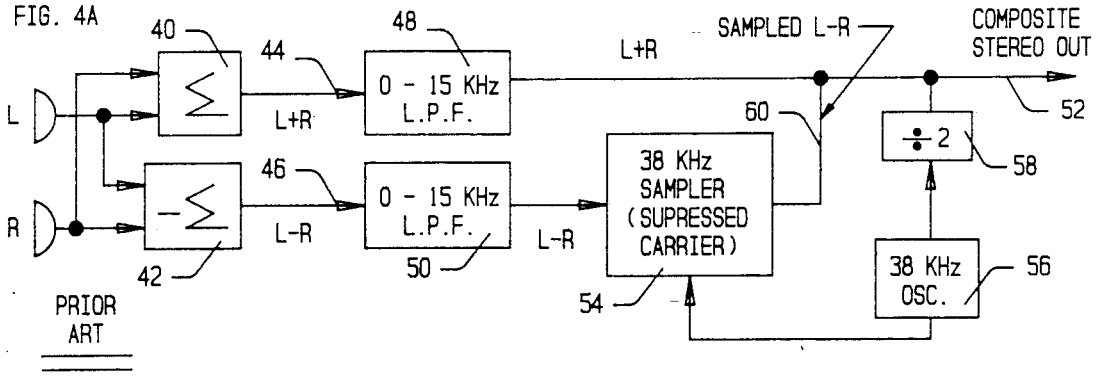
FIG. 4-A is a block digram illustrating a general form of known apparatus for generating the standard composite stereo signals.
FIG. 4B is an idealized frequency spectrum diagram showing the frequency bands occupied by the standard composite stereo signal.

First there will be described one standard way in which the composite stereo signal is originally generated by generator 18 at the studio, as shown in FIG. 4A.

The audio signals from Left microphone L and Right microphone R are supplied to adder 40 and to subtracter 42, to form at respective output lines 44 and 46 a signal L+R proportional to the sum of the L and R signals and a signal L−R proportional to the difference of these two signals. These sum and difference signals are band limited to a low-frequency band of about 50 Hz to 15 KHz by respective low-pass filters 48 and 50 (nominally 0–15 KHz). The filtered sum signal L+R is supplied directly to output line 52, while the filtered difference signal L−R is supplied to the 38 KHz suppressed-carrier sampler 54, to which a stable 38 KHz sampling or modulating signal is supplied from oscillator 56. Sampler 54 produces, on its output line 60, a double side-band suppressed-carrier signal centered at 38 KHz and having upper and lower sidebands corresponding to L−R, which signal is supplied to output line 52. In addition, the 38 KHz from oscillator 56 is passed through a 2 to 1 divider 58 to generate a 19 KHz signal, which is also supplied to the output line 52.

Figure 4B:
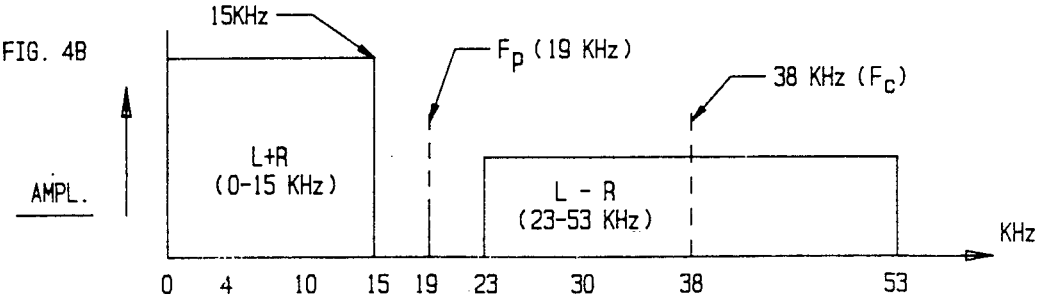

Accordingly, on output line 52 there appears a signal having the frequency spectrum shown in FIG. 4B, consisting of the nominally 0–15 KHz (L+R) signal, the 19 KHz pilot carrier, and the suppressed-carrier, 38 KHz, double sideband L−R signal occupying the range from 23 to 53 KHz. This is the standard composite stereo signal for transmission of stereo audio, for radio broadcast purposes. It can be produced by various processes, but the final composite signal must have the composition shown in order to meet the standards.

Figure 5A:
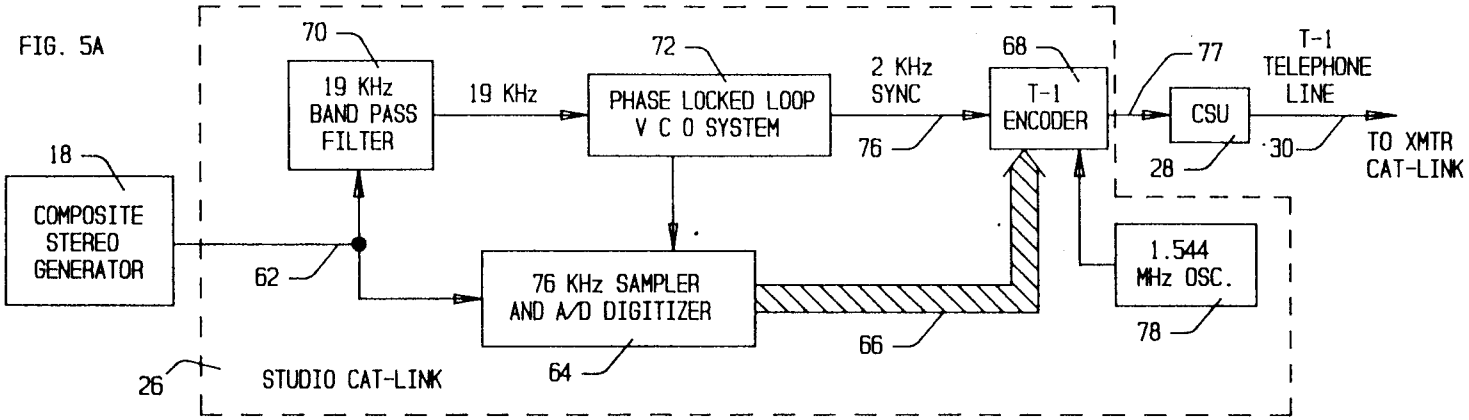
FIG. 5A is a block diagram showing the general nature of the studio CAT-Link of the invention, which receives the composite stereo signal and processes it for application to a telephone line.

FIG. 5A shows the conventional composite stereo generator as a single block 18, the output of which is to be reproduced at the input of the remote FM transmitter 12. The apparatus of the invention comprises those elements of FIG. 5A and 5B which take the output of composite stereo generator 18 and reproduce it at the input to remote FM transmitter 12, in the manner presently to be described.

Considering first the studio CAT-link 26 of FIG. 5A, the composite stereo signal from generator 18 is applied over line 62 to an input of a 76 KHz sampler and A/D digitizer 64, which samples the entire composite stereo sample at a rate which is equal to twice the suppressed-carrier frequency $F_c$; that is, in this example using a suppressed subcarrier frequency of 38 KHz, the sampler operates at 76 KHz, and each sample so taken is converted to a digital signal. As described in detail hereinafter, the phase of the 76 KHz samplings with respect to the phase of the subcarrier is such that one alternate set of samples so taken represents the contemporaneous value of the Left or L signal (plus or minus a known constant due to the pilot carrier), while the other alternate set of samples represent the contemporaneous value of the Right or R signal (plus or minus the same known constant). More particularly, the output of sampler and A/D digitizer 64 consists of a 16-bit byte containing bits representing the amplitude of the Left signal plus pilot carrier, then a similar byte representing the amplitude of the Right signal plus pilot carrier, and so on alternately. These alternating Left and Right sample values are generated in parallel bit form, and are passed over parallel data line 66 to the T-1 encoder 68.

In order for the phase of the 76 KHz sampling signal to be correct with respect to the subcarrier, it is derived from the input 19 KHz pilot signal as follows. A 19 KHz bandpass filter 70 selects the pilot signal from the composite stereo and supplies it to the input of a phase-locked loop VCO system 72, which may be of conventional form, and which produces on its output line 74 the desired 76 KHz sampling control signal in phase and frequency lock with the 19 KHz pilot signal; since the pilot signal and the subcarrier frequency are held tightly in close phase and frequency synchronization in the composite stereo generator, the desired fixed phase and frequency synchronism between the 76 KHz sampling and the 38 KHz subcarrier is obtained.

In addition to the digital Left and Right signal samples supplied to the T-1 encoder 68, the latter encoder also receives a synchronizing signal over line 76 from the phase- locked loop VCO system 72. This synchronizing signal recurs in phase and frequency lock with the 19 KHz pilot. In the present example, it may be a set of bits, e.g. 1000000001, recurrent at 2 KHz, the recurrence period of which signal in effect defines a frame of digital information; the frame time is the inverse of 2 KHz, namely 0.5 millisecond.

A crystal-controlled oscillator 78 operating at 1.544 MHz also provides signal to the T-1 encoder; the latter frequency is that which the T-1 telephone line proprietor requires for the digital information supplied to the line. In the event that the signal bits available for application to the telephone line are not sufficient to provide the 1.544 MHz bit stream, it is the obligation of the sender to fill in substantially all of the remaining gaps in the stream with 1's. Alternatively, other useful bits of information may be used to fill in the empty slots. These requirements and procedures are well known in the prior art and need not be described here in detail.

The T-1 encoder 68 then has available at its input the 2 KHz sync signal, the 1.544 KHz clock signal, the alternating Left and Right sample information encoded in words of, for example, 14 to 16 bits, these samples together recurring at the 76 KHz rate, and any auxiliary slot-filling bits which may be used to fill empty slots in the bit stream for the T-1 line. As will be described in more detail later herein, the T-1 encoder then operates to place upon its output line 77, for passage through CSU 28 to the T-1 telephone line 30, a substantially continuous bit stream coded in half-width bipolar form as required by the T-1 line proprietors, the bit stream including a sync word preceding each frame of about 772 bits, in this example. Thus, in the present embodiment, the channel-representing words of say 14–16 bits each, recurrent at 76 KHz, produce $76{,}000 \times 14$–$16$, or 1.064 to $1.216 \times 10^6$ bits per second. Since the frame duration is 1/2000 second, i.e. half a millisecond, the T-1 encoder puts out nominally 772 bits per frame (between 771 and 773 in practice), while the sampling process produces nominally 608 bits per frame for the case in which 16-bit words are used to represent the samples. The T-1 encoder reads out serially at the 1.544 MHz rate. Ten of the extra bit spaces (772 minus 608) are used for the synchronizing word occurring just prior to each frame of channel information bits, which is used in the transmitter CAT-link to identify when each frame begins. The remaining bit spaces are used for auxiliary data or stuffed with 1's.

As noted above, the 76 KHz sampler and A/D digitizer 64 acts on the entire composite stereo composite signal, consisting of the Left and Right channel information plus the contemporaneous value of the pilot carrier, and does not sample merely the Left and Right information itself.

Figure 5B:
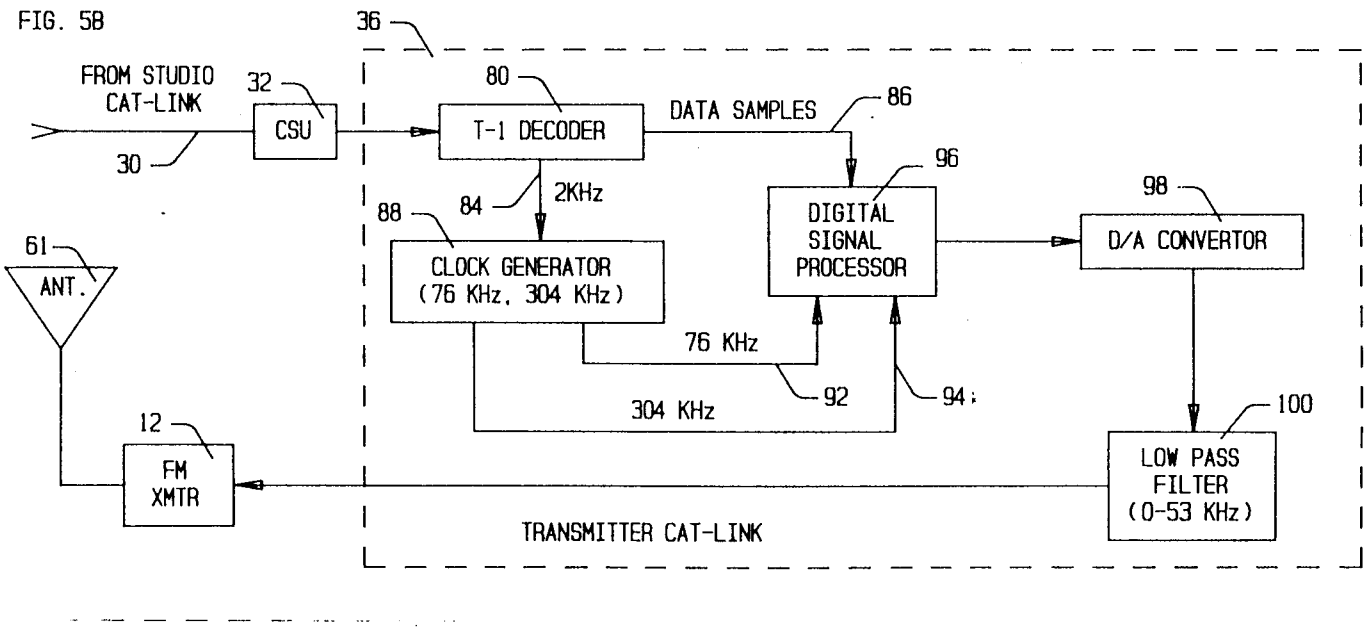
FIG. 5B is a block digram showing the general nature of the transmitter CAT-Link of the invention, as used to receive the signal from the telephone line and process it, so as to regenerate the original composite stereo signal for delivery to the FM transmitter.

Referring now to the transmitter CAT-link 36 shown generally in FIG. 5B, the signal from the T-1 line 30 is first passed through a standard CSU 32 for application to the T-1 decoder 80. Since the transmitted bit rate is 1.544 MHz, a clock signal at this rate is easily derived from the received bit stream by conventional means, in the decoder. By detecting the occurrences of the sync words, a 2 KHz clock signal is produced on T-1 decoder output line 84. The data bits representing the composite stereo information, known to occupy specific bit slots following each synchronizing word, are also readily detected and separated, and applied to T-1 decoder output line 86.

The 2 KHz clock signal is applied to the 76 KHz and 304 KHz clock generator 88 to generate, on respective output lines 92 and 94 thereof, 76 KHz and 304 KHz clocks, locked in phase and frequency with the original 19 KHz pilot at the studio CAT-link. The latter two signals, as well as the data on line 86, are supplied to digital signal processor 96, which includes various filtering and matrixing devices to be described in more detail hereinafter. The processed digital information is supplied through the digital-to-analog converter 98 and thence through a the analog low-pass filter 100 having a passband of about 0 to 53 KHz, to the remote FM transmitter 12 as part of the regenerated composite stereo.

As will be described hereinafter, if processor 96 performed only the basic functions described above, its output signal after D/A conversion would be difficult and, as a practical matter, nearly impossible, to filter appropriately so as so remove the undesired frequency components from the signal supplied to the FM transmitter. Accordingly, the processor includes special apparatus for interpolating values into the data stream in such manner as to greatly increase the effective sampling rate, to 304 KHz in the preferred embodiment; such processed signal may be much more easily filtered to remove undesired components prior to its application to the FM transmitter. In addition, the processor receives Left and Right samples taken at slightly different times, and produces from them, by interpolation, Left and Right samples corresponding to the same sample times, so that proper matrixing can be performed, as explained below.

Before discussing various preferred details of the system, it will be helpful to describe the theory of the timing and frequency considerations involved in the operation of the invention.

As mentioned above, FIG. 4B shows the typical spectrum of the standard composite stereo signal. It comprises a low-frequency band extending from near zero to about 15 KHz and containing frequency components representing the instantaneous sum of the Left channel signal and the Right channel signal; the lower frequency limit may not be exactly zero, due to difficulties in passing extremely low frequencies, and may actually be about 50 Hertz, for example. It also contains a pilot carrier signal P at a frequency $F_p$ equal to 19 KHz, and a subcarrier consisting of double-sideband suppressed-carrier components centered at 38 KHZ and extending 15 KHz above and below the center subcarrier frequency of 38 KHz. It might be expected from the Nyquist criterion that to transmit this composite stereo signal faithfully, it would be necessary to sample it at twice the frequency of the highest frequency component, namely at twice 53 KHz or at 106 KHz, as a minimum. In practice, it would in fact be expected that to leave an appropriate margin of error to take care of various system considerations and the transmission of other appropriate related synchronizing and control signals, one would have to sample at, say, 120 KHz or more. As pointed out above, using 16 bits to represent each sample value would then require a bit rate of about 1.9 megabits per second, much higher than the 1.544 megabits per second which a standard T-1 line will accommodate. Even using fewer quantitized levels, for example 14 bits per sample, would require a substantially higher bit rate than is permitted by the T-1 line system.

In accordance with the invention this limitation is overcome by sampling the composite signal at twice the suppressed carrier signal frequency $F_c$, in this case at 76 KHz, and in a specific controlled phase relation. Using 16 bits per byte, this requires only 1.216 mega-bits per second. The phase of sampling required is illustrated by the following analysis.

Let C(t) equal the total standard composite stereo signal as a function of time t.

Let L(t) equal the instantaneous value of the left stereo channel.

Let R(t) equal the instantaneous value of the right stereo channel.

Let $F_p$ equal the frequency of the pilot carrier.

Let A equal the amplitude of the pilot carrier.

Then $$C(t)=L(t)+R(t)+A\,sin(2\pi F_p t)+sin(2\pi 2F_p t)[L(t)-R(t)] \quad \text{(Eq. 1)}$$

In this equation the first term is the Left stereo channel signal, the second term is the Right stereo channel signal, the third term is the pilot carrier P of amplitude A and frequency $F_p$, and the fourth term is the double-sideband suppressed-carrier subcarrier signal, modulated with the difference between the Left and Right channel signals.

Figure 6:
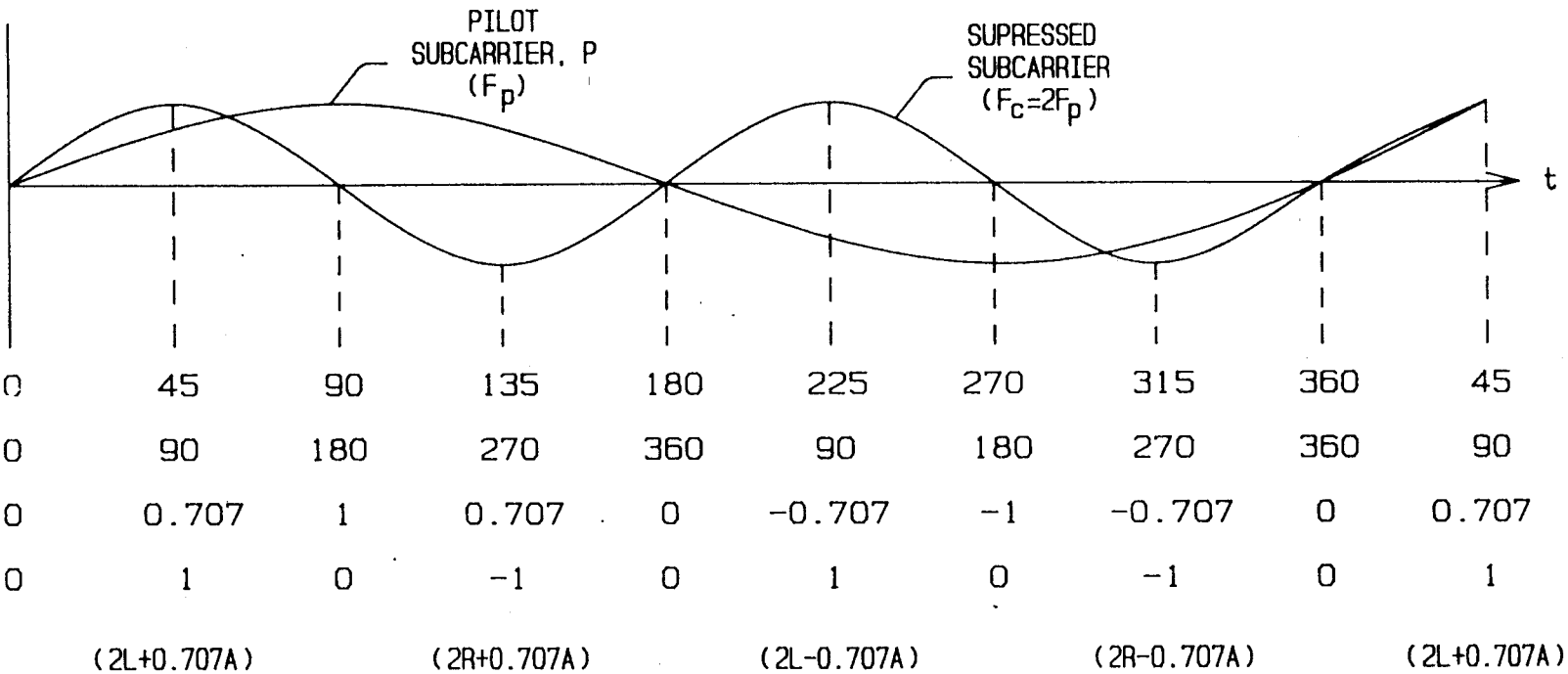
FIG. 6 is a graphical representation, with chart, showing the phase relations of the pilot carrier, the subcarrier frequency, and the times of sampling of the composite stereo signal in accordance with the invention.

FIG. 6 shows the pilot carrier marked P at frequency $F_p$, and a sine wave at the frequency $F_c$ of the suppressed subcarrier; the vertical dashed lines indicate the phases of sampling at twice the subcarrier frequency. It will seen that sampling occurs at the first 45° of phase of the pilot carrier and at successive 90° phase increments thereafter, namely at 45°, 135°, 225°, 315° etc. The corresponding subcarrier phases at which sampling occurs are 90°, 270°, 90°, 270° and so on. The significance of these times of samplings will be appreciated with the aid of the following Table 1:

| Phase of Subcarrier $F_c$ | Phase of Pilot Carrier $F_p$ | Composite Signal (Ct) |
|---|---|---|
| 0° | 0° | L(t) + R(t) |
| 90° | 45° | 2L(t) + .707A |
| 180° | 90° | L(T) + R(t) + A |
| 270° | 135° | 2R(t) + .707A |
| 0° | 180° | L(t) + R(t) |
| 90° | 225° | 2L(t) − .707A |
| 180° | 270° | L(t) + R(t) − A |
| 270° | 315° | 2R(t) − .707A |
| 0° | 0° | L(t) + R(t) |

Table 1 shows the values of the composite signal C(t) for each of the listed phases of the pilot carrier at $F_p$ and of the subcarrier $F_c$. It will seen that at 45° of the pilot carrier (at 90° of the subcarrier), the composite signal value C(t) is 2L(t)+0.707A) and at 225° of $F_p$ (the next 90° phase point of the subcarrier) it is 2L(t)−0.707A. The values 2L(t)+0.707A and 2L(t)−0.707A alternate in this manner for all subsequent cycles of $F_p$. Also, at 135° of $F_p$ (270° of the subcarrier) the composite signal value is 2R(t) +0.707A, and at 315° of $F_p$ (the next 270° phase point of the subcarrier), it is 2R(t)−0.707A. Accordingly, by sampling at the alternate positive and negative peaks (90° and 270° points) of the subcarrier frequency, samples are obtained which represent, alternately, twice the Left channel signal amplitude and twice the amplitude of the Right stereo channel signal, in each case plus or minus 0.707 of the known amplitude A of the pilot carrier at that same phase position. It is these sample values which are digitized and placed into predetermined slots in corresponding, alternating, 16-bits words for transmission to the transmitter CAT-link, as described generally above and in more detail below.

Figure 7:
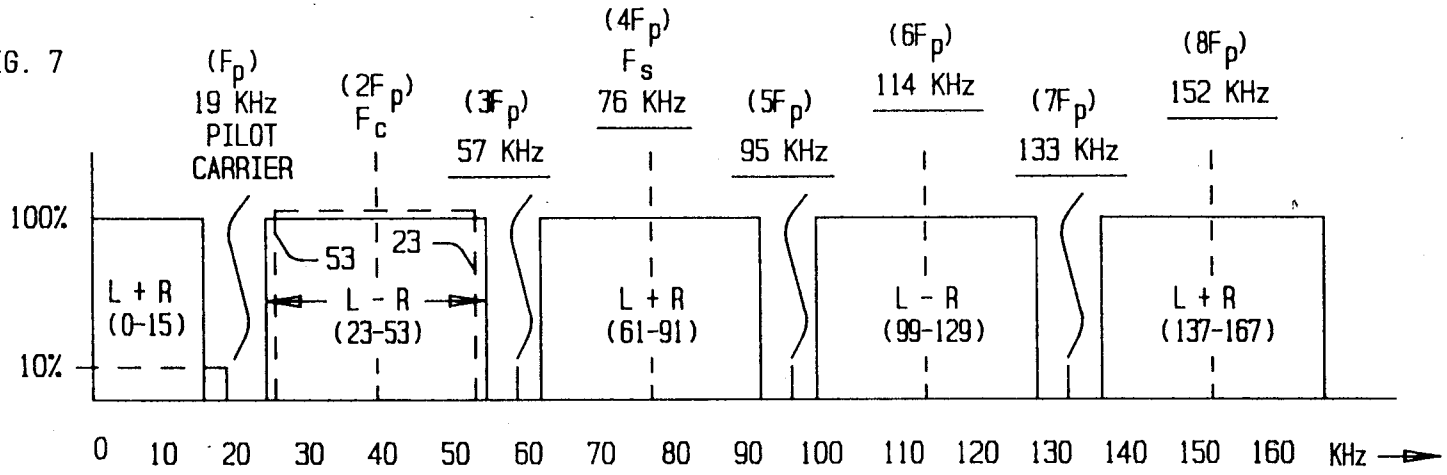
FIG. 7 is an idealized frequency spectrum diagram showing bands of frequency components present in the received signal in the DSP micro processor of the system.
Figure 9G:
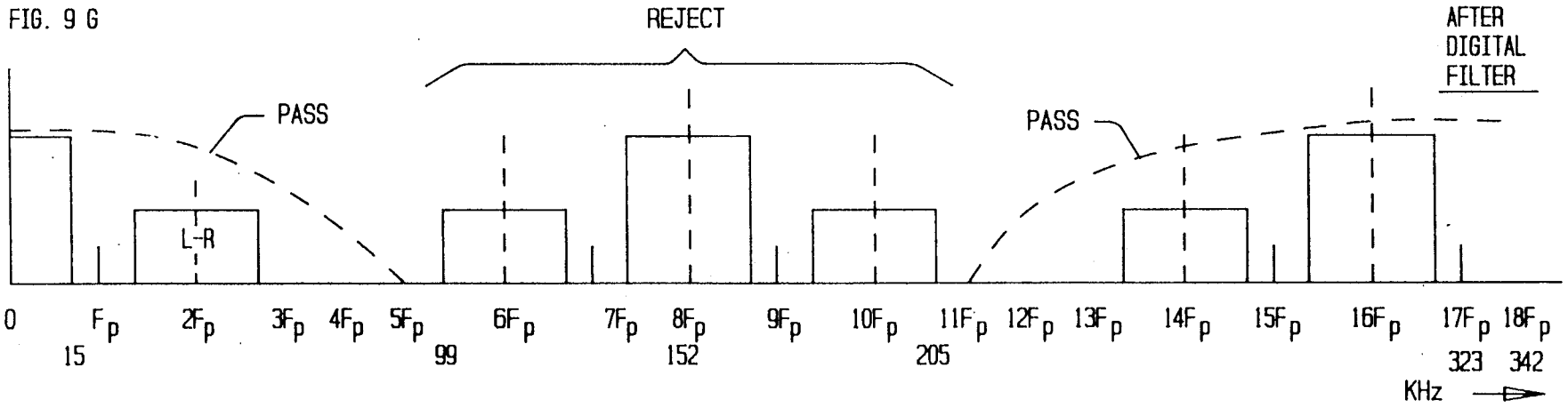
FIG. 9A–9G are a series of spectral diagrams to which reference will be made in explaining the operation of the invention.

Referring now to the spectrum diagram of FIG. 7 showing the significant part of the spectrum of frequency components transmitted from studio to transmitter location, in addition to the standard composite stereo signal shown therein in the frequency band below 53 KHz there are shown the sampling frequency 76 KHz; the upper and lower side-bands around 76 KHz (extending from 61 to 91 KHz) formed by modulation with the L+R signal; and, in broken line, the positions of the lower 23-53 KHz sideband of 76 KHz formed by intermodulation of the 23-53 KHz (L−R) signal with the 76 KHz sampling frequency component. The latter lower sideband of frequency components lie within the same band as the L−R component of the composite stereo, although the frequency components are arranged in opposite order with respect to frequency; that is, in this lower sideband the original 53 KHz component of the composite stereo signal appears at 23 KHz, and the original 23 KHz component of the composite stereo signal appears at 53 KHz. Also shown is a 5-times pilot carrier component at 95 KHz, and a band of double-sideband modulation components extending on each side of 114 MHz from 99 to 129 KHz, formed by intermodulation of the sampling frequency 76 KHz with the original (L−R) signal band. Further shown is a component at 7 $F_p$=133 KHz and another L+R band of components extending from 137 to 167 KHz.

The above-described folding back of the (L−R) lower sideband of 76 KHz into the same frequency band occupied by the original (L−R) signal is inherent in the use of a sampling frequency twice that of the subcarrier. More particularly, if $f_a$ represents any frequency component of the original L−R signal, then its initial modulation with $F_c$ produces a lower sideband at $F_c-f_a$. When this is modulated with $F_s$ it produces a lower sideband $F_s-(F_c-f_a)$. Since $F_s=2F_c$, this lower sideband is at $2F_c-F_c+f_a=F_c+f_a$.

This demonstrates that by using twice the subcarrier frequency $F_c$ as the sampling frequency $F_s$, each original frequency component of (L−R) will be represented at a frequency spaced from $F_c$ by the same amount as in the original signal, but in the opposite direction in the spectrum region 23 to 53 KHz.

Figure 8:
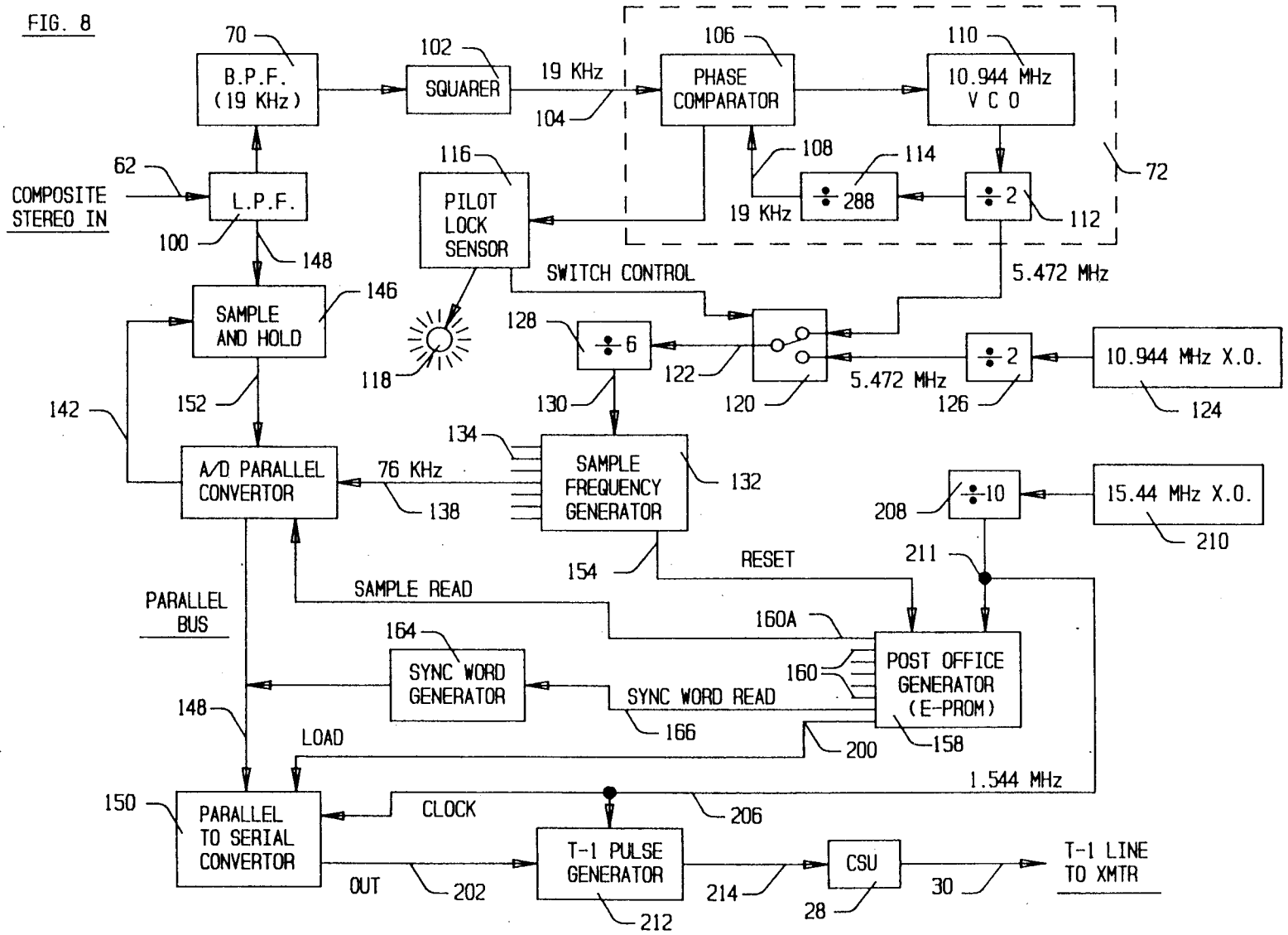
FIG. 8 is a detailed block diagram of a studio CAT-Link constructed according to the invention.

FIG. 8 shows in more detail a preferred embodiment of the studio CAT-Link. The standard composite stereo signal at the studio location is applied over input line 62 to a low-pass filter 100 having a passband of about 0 to 300 KHz. One output of this low-pass filter is applied to bandpass filter 70, which selects the 19 KHz pilot carrier and passes it to a squarer 102, wherein it is converted to square-wave shape in conventional manner, at 19 KHz pulses per second. The latter signal is applied over line 104 to one input terminal of phase comparator 106 in phase locked-loop system 72 (enclosed in broken lines).

The other input to phase comparator 106 is provided on line 108, and is a 19 KHz carrier derived from a carrier generated in a 10.944 MHz voltage-controlled oscillator 110, by frequency division first in the two-to-1 divider 112 and then in the 288-to- 1 divider 114. The phase-locked-loop 72 employs conventional principles to hold the 19 KHz fedback signal, as well as the 5.472 MHz signal from the 2-to-1 divider 162, in phase and frequency lock with the original 19 KHz pilot carrier from the composite stereo signal.

The phase-locked-loop system is also provided with a pilot lock sensor 116 which may be of conventional form, and which senses when the loop is locked and when it is not. When locked, the sensor illuminates a lamp 118, and switch 120 is in a position in which the 5.472 MHz form the 2-to-1 divider 112 is passed through to switch output line 122; when phase lock is lost the lamp is extinguished and the switch automatically moves to its lower position, in which the switch output line 122 is again supplied with a 5,472 MHz signal, but in this case from a 10.944 MHz crystal oscillator 124 after dividing down 2-to-1 in frequency divider 126. This arrangement is provided to assure that, even if phase lock is lost, there will be bits read out onto the T-1 line at the required 1.544 MHz rate, to keep the system operating until such time as phase lock is resumed.

The 5.472 MHz signal form switch 120 is passed through a 6-to-1 frequency divider 128 to produce on the divider output line 130 a 912 KHz signal, also in phase and frequency lock with the original pilot carrier.

The 912 KHz is supplied to the sample frequency generator 132, which has a number of output taps such as 134 corresponding to different down-counts from 912 Khz, i.e. providing different output signals at different submultiples of 912 KHz. One of these is at 76 KHz, and is supplied over the line 138 to A/D parallel converter 140. The latter converter is connected over Sample And Hold control line 142 to the control terminal of Sample And Hold circuit 146, which circuit also receives the composite signal from output line 148 of low pass filter 100. As described above, the 76 KHz on line 138 is phase and frequency locked with respect to the original 19 KHz by phase-locked loop 72, and any circuit phase delays may be compensated by adjustment of a conventional phase delay compensator in the 19K bandpass filter 70, so that sampling of the composite stereo signal occurs exactly at the above specified 45°, 135°, 225° and 315° phase positions of the original pilot carrier, corresponding to the phases of the subcarrier at which it alternately represents the Right and Left stereo channel signals (plus or minus a known, fixed constant in each case). The resultant samples are supplied to the output line 152 of the Sample And Hold circuit, in response to command signals on line 142.

Output line 154 of the Sample Frequency Generator 132 generates a framing reset signal, nominally at 2 KHz, which is the 456th submultiple of the 912 KHz. This framing signal is applied to Post Office Generator 158, which is an EPROM having a plurality of output lines such as 160 producing clock signals at preselected intervals and phases during each 2 KHz frame time. It serves to control when various bits are inserted into slots in the bit stream for best efficiency. In the present example, the top output line 160A serves as a Sample Read line and is connected to A/D parallel converter 162. Each time a Sample Read pulse is produced, a sample held in the Sample and Hold circuit 146 is converted by A/D parallel converter 140 to a 16 bit word and transferred to parallel data bus 148, and thence to the input of parallel-to-serial converter 150.

In addition to the bits of the 16-bit words representing the samples, a sync word is generated in sync word generator 164 and applied to bus 148 at the beginning of each frame, at times controlled by "Sync Word Read" signals on line 166.

The bus 148, in this embodiment, may contain not only the 16-bit parallel data line, but also 8 write/read lines, 8 sample clock lines, 8 general input/output lines, a 5.472 MHz master clock line, a master reset line and power and ground lines, preferably used for timing and control purposes.

The output line 200 of Post Office Generator 158 supplies a pulse to the "Load" input terminal of the parallel-to-serial converter 150, instructing it to load each word of parallel data from the data bus 148 and to store it until it is clocked out onto line 202. The clocking-out function is provided by clocking pulses applied to clock input line 206, to which a 1.544 MHz clock is supplied; the latter clock pulses are derived by passing through 10-to-1 divider 208 a 15.44 MHz clock from crystal oscillator 210; the 1.544 MHz clock pulses also being supplied over line 211 to Post Office Generator 158 for timing purposes.

Each set of parallel bits is thus serially clocked out over serial output line 202 to the T-1 pulse generator 212, which is also supplied with 544 MHz clock and which generates and supplies to its output line 214 a standard T-1 digital signal of the half-width bipolar type, representing in sequence the samples of the composite stereo signal and the sync bits defining the frame time.

FIG. 10 shows further details of the portion of the apparatus which receives the composite stereo transmitted by the studio CAT-link, in this embodiment. Referring to that Figure, the digitized encoded signal on the t-1 line 30 is supplied to a T-1 receiver 300, which performs the usual inverse functions for receiving a T-1 coded signal, decoding it and converting it to the serial bit form which it had at the input to the T-1 pulse generator in the studio CAT-link.

The latter reconstituted serial-bit signal is applied to Clock Recovery Unit 302, which may use conventional circuitry to count the received bit rate and put out, on its output line 306, a series of 1.544 MHz clock pulses. The latter clock pulses are passed through a 2-to-1 frequency divider 308 to produce, on its output line 310, 772 KHz clock pulses for application to a first control input of phase comparator 312 of phase-locked-loop system 314. Within the phase-locked-loop system, there is provided a 15.44 MHz voltage controlled oscillator (VCO) 316, the output frequency of which is divided by 10 by the divider 318 to produce a 1.544 MHz clock signal on line 320. The latter clock pulses are passed through 2:1 divider 322 to produce, on its output line 324, clock pulses at 772 KHz, which are supplied to the second control input of phase comparator 312. The phase-pulses locked in phase and frequency with the 772 KHz pulses locked in phase and frequency with the 772 KHz received clock pulses on line 310, in a well known manner.

However, since the locking action requires some phase difference between the two signals to the phase comparator to provide the desired control of the frequency of the VCO 316, the fed back clock pulses designated as at 722 KHz are subject to very small phase variations with respect to the 772 KHz received clock pulses. For convenience, the received clock pulses will be designated as Phase B clock pulses and the derived 722 KHz signals as phase A clock pulses; similarly clock pulses derived from these two respective sources, namely from the receiver and the phase-locked loop system, will be designated as Phase B or Phase A clock pulses respectively, where appropriate to emphasize this distinction. While the 772 KHz signal is used to accomplish locking of the loop, it is the 1.544 MHz signal from the 10:1 divider 318 in the phase-locked-loop which is supplied over line 330 to one input terminal of the Post Office Generator 332.

T-1 Receiver 300 also produces, on an output line 340 thereof, the recovered data signals in serial form, including the synchronizing bits. The presence of the synchronizing bits is detected by applying the latter signal to sync detector 342, which stores bits corresponding to sync bits and compares its received input signal on line 344 with stored internal sync bits to determine when the two sets of bits coincide; when there is such a coincidence, the sync detector puts out a "Sync Found" signal on its output line 350. When the sync system is locked in, the "Sync Found" signal will be at the 2 KHz frame rate, and will have a phase indicative of when each frame begins.

Since in this example the sync consists of 10 bits, namely 1000000001, which can at times occur as part of the data-representing bit stream, special means are provided for assuring that the sync detector locks on the proper set of bits. This is one function of the Post Office Generator 332, which produces at its tap TW6 a "Sync Watch" pulse intended to start at bit 771, and applies this to Sync Detector 342. When the system is locked in, the Sync Detector will be responsive to the sync signal only if it appears in a short 12-bit interval starting at bit 771. Prior to sync lock in, the "Sync Watch" pulse occurs at times counted by means of the 1.544 KHz clock signal, but in no particular relation to when the sync bits will appear. If in fact a "Sync Watch" pulse occurs at a time such that the Sync Detector 342 embraces and detects the sync patterns, the "Sync Found" signal resets the Post Office Generator at that time, so that 771 bits later the "sync" pulse will occur again; that is, if the set of bits is in fact a set of sync-representing bits, these bits will appear again during the next "Sync Watch" pulse 772 bits later, and will continue to reappear at such intervals, thus maintaining the desired synchronization lock. If instead the sync pattern is initially not found during the next "Sync Watch" interval, no "Sync Found" signal occurs and the Post Office Generator generates its "Sync Watch" pulses progressively one bit later each cycle, in effect searching for the sync pattern. Although it is possible for two or more sets of false sync bits to occur at 772 bit intervals, there is no systematic reason for this to occur, and the chances that it will occur more than a very few times is extremely remote; in practice, true sync lock typically occurs within a few thousandths of a second. Upon sync lock, the Post Office Generator is supplied with the 1.544 MHz pulses from the phase-locked loop and with the 2 KHz frame rate pulses from the Sync Detector 342.

The Post Office Generator produces at its eight output lines TW-0 to TW-7 any and all of the control pulse phases and frequencies desired for the functions that will be described. The use of TW-6 for the sync "watch" pulse has been mentioned above. TW-0 supplies control pulses to a Left Data Latch 360 which are coincident with the durations of the alternate 16 bit bytes representing the Left stereo channel information, while TW-1 supplies Right Data Latch 362 with pulses concident with the occurences of the alternate 16-bit bytes representing the Right channel information. In this way, the Left and Right parallel sample information is clocked into the Left and Right Data Latches respectively, to separate Left and Right data into two different channels.

It will be recognized that the sample data contained in the Left and Right Data Latches represent values which are actually the sums of the Left and Right channel values plus or minus 0.707 of the amplitude A of the pilot carrier, as set forth in the foregoing Table 1. It is the primary function of the remainder of the system to reconstruct, from the data in the Left and Right Data Latches, the original composite stereo signal and apply it to system output line 364, as will now be described.

TW-7 provides a load pulse to Serial-To-Parallel Converter 379 to time the conversion from serial to parallel of the data signal from the T-1 receiver. Various others of the phase-and-frequency locked outputs of the Post Office Generator are used as indicated hereinafter.

Timing for the operations of the apparatus for regenerating the composite stereo is provided by Sample Frequency Generator 370, which itself is part of a phase-locked-loop comprising a phase comparator 372 and a 10.944 MHz VCO 374, the output which is divided down in frequency first by 2:1 in divider 376 to produce a 5.472 MHz clock, and then by 6:1 divider 378, to produce a clock at 912 KHz on line 380 for application to the Sample Frequency Generator 370. The sample frequency generator has seven output terminals TC-0 to TC-7 at which appear different frequencies, locked in frequency and phase to the original received pilot carrier frequency, as follows. The output at TC-0 of the Sample Frequency Generator is at 2 KHz, divided down from the 912 KHz clock applied to the Sample Frequency Generator. This 2 KHz is divided by 2:1 in divider 386 and applied as a 1 KHz phase A signal to a control input of phase comparator 372, the other control input of which is supplied with the 1 KHz, Phase B signal derived directly from the received pilot carrier via Sync Detector 342 and 2:1 divider 390.

The remainder of the system is designated as the composite output module, and is shown within the broken lines in the lower left-hand portion of the FIG. 10. It comprises a DSP microprocessor 400, which may be a commercial Digital Signal Processing microprocessor, and which serves as the master control to which the other elements of the composite output module are slaved. An internal 24-bit wide parallel data bus 402 interconnects the microprocessor, the Left Data Latch 310, the Right Data Latch 362, a first finite impulse response digital filter chip (FIR Chip #1), a second finite impulse response digital filter chip (FIR Chip #2), a Boot PROM 406 for the microprocessor 400, and a double buffer 408, the output of which is also connected, by extension of the bus, to the parallel-to- serial converter 410. As will described more fully hereafter, the output of the parallel-to-serial converter 410 is supplied to a digital-to-analog converter 414 to recover the composite stereo signal in analog form; the latter signal is passed through an analog low-pass filter 418 to eliminate any remaining frequency components which may be present beyond the upper frequency limit of the standard composite stereo signal, thus accomplishing the desired regeneration of the composite stereo.

Returning now to the composite output module in more detail, it addresses and accommodates several practical problems associated with reconstructing the composite stereo from the data contained in the Left and Right Data Latches. One practical problem involves the unwanted frequency components present in the regenerated signal due to the sampling procedures employed; as shown in FIG. 7, in this embodiment these unwanted components begin at 3 times the pilot carrier frequency $F_p$ and extend upwardly therefrom. Since in this embodiment 3 times $F_p$ is 57 KHz, and the upper limit of the desired L−R subcarrier channel is at 53 KHz, it would be necessary to retain all 0–53 KHz signals but to reject 57 KHz and all higher frequencies. A conventional analog filter which will pass all the signals up to 53 KHz with linear phase response and yet reject those at 57 KHz and above is very difficult to realize, as a practical matter.

A second consideration, apparent from a comparison of FIG. 4B with FIG. 8, is that the amplitude of the L−R subcarrier frequency components in the received signals, relative to the original L+R frequency components, is twice as great as in the original composite stereo signal; that is, in the original stereo signal, the L−R subchannel signal amplitude was one-half that of the L+R base band channel, while in the spectrum of the sampled and transmitted signal, these two bands are of equal amplitude. If this were not corrected, significant distortion of the final stereo sound would result. Also, since the L+Pilot and R +Pilot samples are taken at slightly different times at the studio CAT-Link, combining them directly to recover L+R and L−R would not be successful; the composite output module addresses this problem as well.

In solving these problems, the preferred embodiment of the present invention uses a standard interpolation technique to enable effective filtering of the undesired from the desired signal components and to provide L−R and L+R samples for the same signal phases, and also provides the desired amplitude relation between low-frequency L+R signals and subcarrier L−R signals by, in effect, forming the appropriate L+R, L−R and pilot carrier components separately, and then combining them in the proper relative magnitudes, as will now be described.

In general, the composite output module employs the finite impulse response (FIR) digital lowpass filters #1 and #2 to accomplish a double interpolation of data values between the 38 KHz samples in the Left and Right Latches, thereby effectively multiplying the apparent sampling rate for each channel, from twice the pilot carrier frequency, or 38 KHz, to four times the pilot carrier frequency, or 76 KHz for each channel; in addition, the FIR's lowpass characteristics delete the pilot carrier signal P(n) while leaving the L or R signals below 15 KHz unmodified. The spectral diagrams of FIG. 9 and the flow diagram of FIG. 11 illustrate in detail the preferred structure and operation of the composite output module.

Figure 9A:
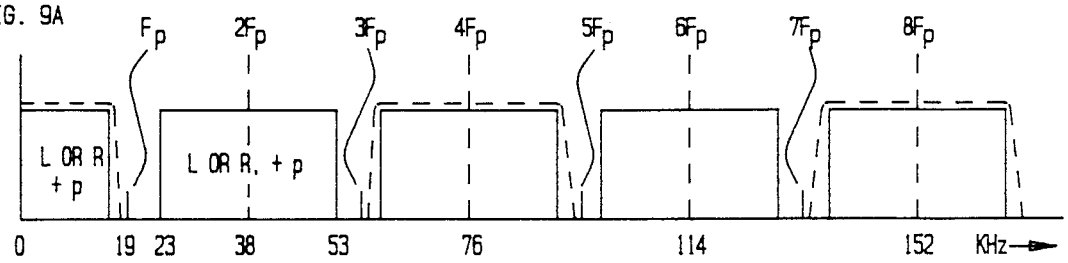
Figure 9B:
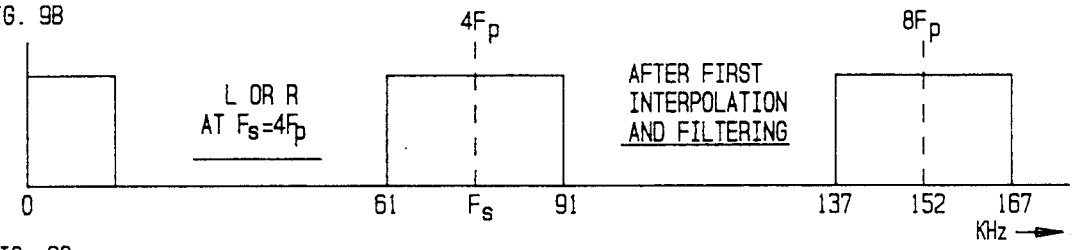

FIG. 7 discussed above shows the digital domain spectrum of the composite stereo signal C(n), after sampling at a 76 KHz frequency, locked to the pilot carrier frequency $F_p$. This signal is provided at the transmitter CAT-Link at the output of T-1 receiver 300, as represented at 500 in FIG. 11 by the step "Receive C(n) at $4F_p$ Word Rate". The serial-to-parallel converter 379 of FIG. 10 converts the received signal to parallel form and supplies it alternately to left and right data latches 360 at 362, as represented by step 502 of FIG. 11, namely "Separate L+P(n) Words From Alternate R +P(n) Words", where P(n) is the pilot carrier signal; the two outputs of this step are L+P(n) at $2F_p$ and R +P(n) at 2F(p). FIG. 9A shows the idealized spectrum for the latter signals in the data latches, it being understood that the graph represents the spectrum for either the R or the L signals.

Figure 11:
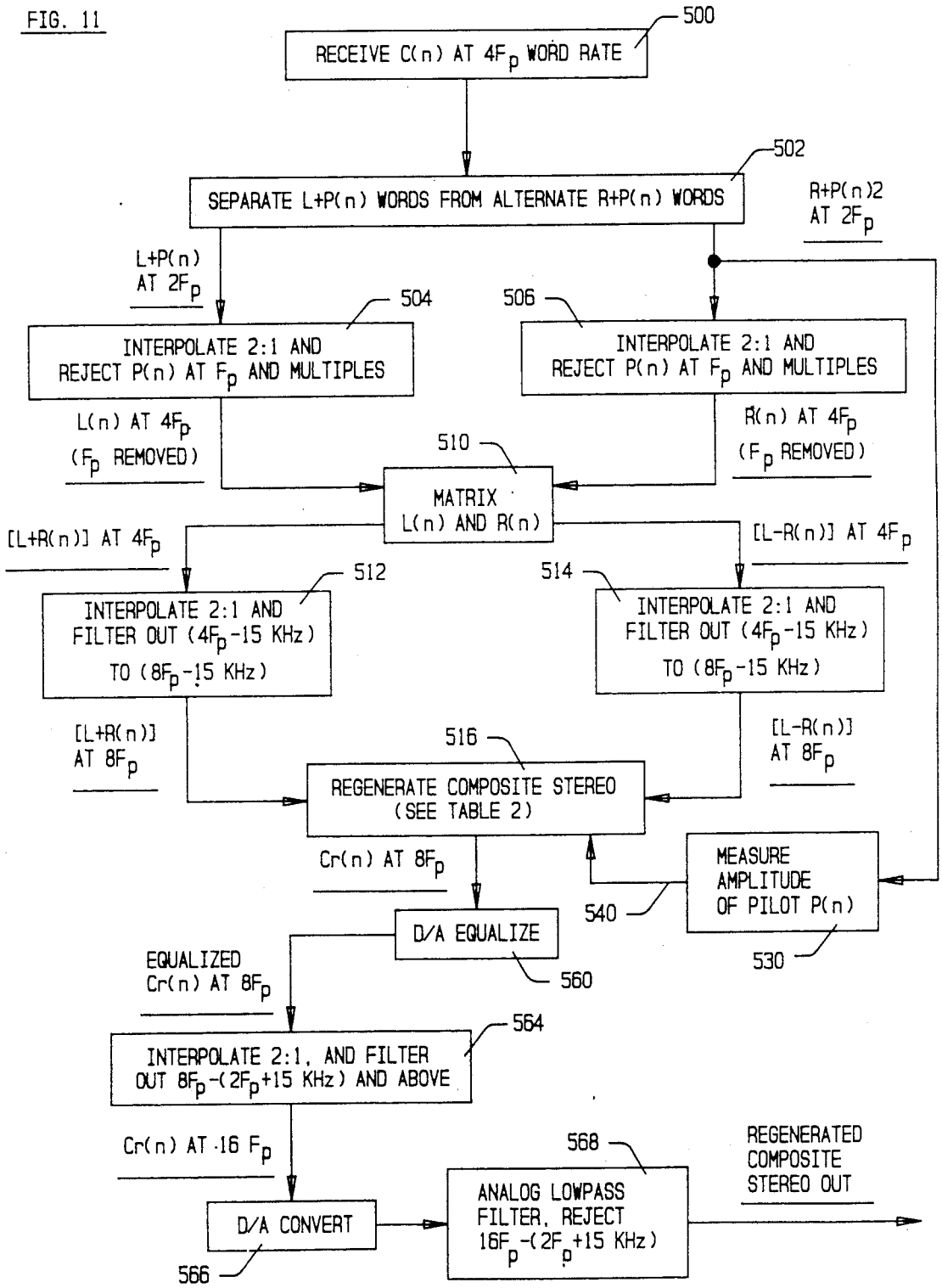
FIG. 11 is a flow diagram illustrating a preferred sequence in processing the received signal in the transmitter CAT-link.

FIG. 9A also shows, in heavy broken line, the spectral bands which are selected by the next step performed by the FIR chip #1 and the FIR chip #2 under control of DSP microprocessor 400, namely, as represented at 504 and 506 of FIG. 11, "Interpolate 2:1 and Reject P(n) at $F_p$ and Multiples." This process leaves only the baseband and the bands about $4F_p$ and $8F_p$, which in the case of the Left latch output is L(n) at $4F_p$ and in the case of the Right latch output is R(n) at $4F_p$. The resultant signals correspond to L and R sampled at $4F_p$, and is shown at 9B.

The 2:1 interpolation also serves another function, in producing samples of L and R corresponding to the same sampling times. It will be appreciated that the original samples (see FIG. 6) for L and R were taken at times differing by half a sampling period at 76 KHz; it has been found that if those samples are used to regenerate the composite signal by treating them as if they had been obtained simultaneously, significant degradation of the quality of the standard composite stereo signal results. This difficulty is overcome by the 2:1 interpolation, which responds to the L(n) and R(n) signals, respectively, to produce an estimated, interpolated, sample value midway in time between the actual samples; FIR chip #1 does this (and filters out $F_p$) for one signal, say L(n), and FIR chip #2 performs these operations for the other signal, say R(n). Since the original L samples at 76 KHz were taken exactly half-way between the original R samples, the 2:1 interpolation causes each original L sample to occur at the same time as an interpolated R sample, and vice versa. The L(n) and R(n)

samples from the interpolations may therefore be matrixed with each other in the matrixing step 510, without any noticeable loss of fidelity. How to use each such FIR's and microprocessors to perform such 2:1 interpolation and filtering is known in the art, and need not be described in further detail.

Figure 9C:
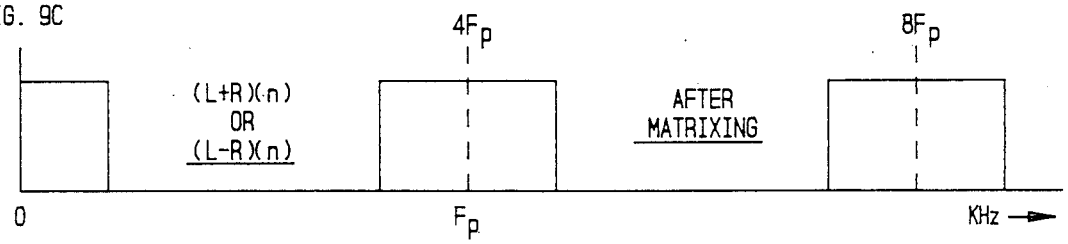

The matrix operation performed in step 510 of FIG. 11 takes L(n) and R(n) at $4R_p$ and from them derives two outputs, namely L+R(n) and L−R(n), both sampled at 4Fp, as shown in the frequency domain in FIG. 9*c*.

Figure 9D:
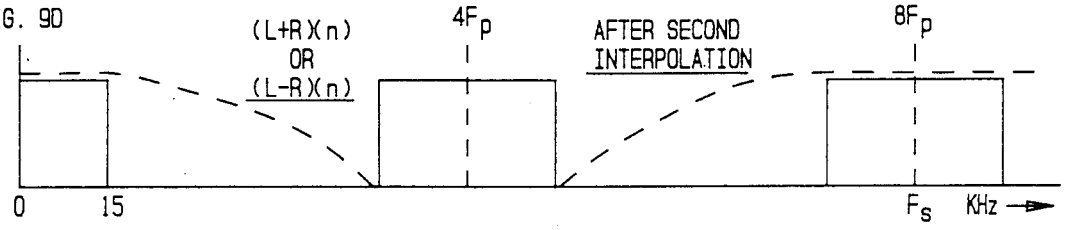

Next, as shown at 512 and 514 of FIG. 11, another 2:1 interpolation is performed, and components between ($4F_p$-15 $KH_z$) and ($8F_p$-15 KHz) are filtered out. FIG. 9D shows the spectrum of FIG. 9C, but with the effective passband of the last-mentioned digital filtering operation shown in heavy broken lines; the operation deletes the band around $4F_p$, and produces a signal representing (L+R)(n) and (L−R)(n) at a sampling rate of $8F_p$.

In the next step 516 of FIG. 11, the "Regenerate Composite Stereo" operation responds to (L+R), (L−R) and to a signal representing the scale of the pilot carrier peak amplitude; the latter signal is obtained by conventional digital frequency-selection of the pilot carrier P(n) from the signal R+P(n) at $2F_p$, produced in step 502 of FIG. 11, and by conventional sensing of its peak amplitude, all in step 530 labelled "Measures Amplitude of Pilot P(n)". This step is performed in an IIR (infinite impulse response) digital filter in the microprocessor 400.

Table 2 below shows the manner in which regeneration of the composite stereo signal is performed in the preferred embodiment.

TABLE 2

| Sample # | Degrees of $F_p$ | Regenerated Composite Stereo | Digital Construction at $8F_p$ |
|---|---|---|---|
| 0 | 0 | L(n) + R(n) + P(n) | (L + R) (n) |
| 1 | 45° | 2L(n) + P(n) | (L + R) (n) + (L − R) (n) + .7PA |
| 2 | 90° | L(n) + R(n) + P(n) | (L + R) (n) + PA |
| 3 | 135° | 2R(n) + P(n) | (L + R) (n) − (L − R) (n) + .7PA |
| 4 | 180° | L(n) + R(n) + P(n) | (L + R) (n) |
| 5 | 225° | 2R(n) + P(n) | (L + R) (n) − (L − R) (n) − .7PA |
| 6 | 270° | L(n) + R(n) + P(n) | (L + R) (n) + PA |
| 7 | 315° | 2R(n) + P(n) | (L + R) (n) − (L − R) (n) − .7PA |
| 8 | 0 | L(n) + R(n) + P(n) | (L + R) (n) |

In Table 2, the first column lists ordinal numbers for a group of 8 successive samples to be represented by the regenerated composite stereo signal. The second column lists the corresponding phase of the pilot carrier at which the samples are taken; the third column shows the sample values to be regenerated in order to reproduce the values of the original samples of the composite stereo signal set forth in Table 1 hereof; and the fourth column shows the way in which L+R, L−R and PA are combined during regeneration to produce the sample values of the third column. Recognizing that P(n) has its peak values PA at 90° and at 270°, and has a value ±.707 PA at 45°, 135°, 225° and 315°, the equivalence of the values in the third and fourth columns is apparent.

Figure 9E:
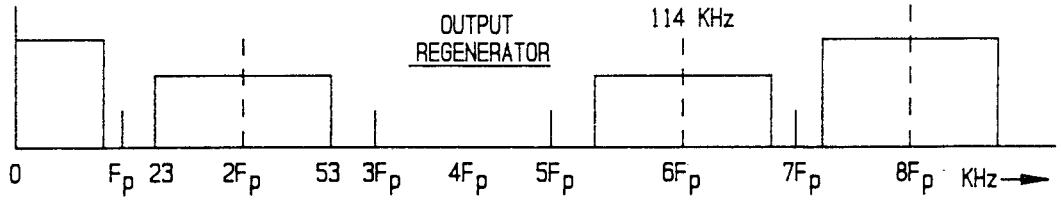
Figure 9F:
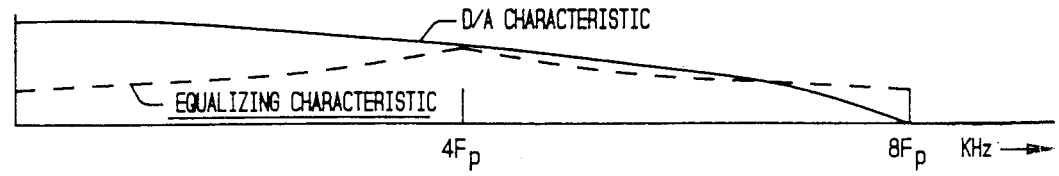

The output resulting from this regeneration is shown in FIG. 9E, to a scale twice that of the other graphs of FIG. 9, and includes in the region 0 to 2Fp+15 KHz the desired signal corresponding to columns three and four of Table 2, but in addition contains higher-frequency components extending from 6Fp-15 upwards. It is very difficult to provide an analog filter which will pass the desired frequency band from 0 to 53 KHz while rejecting the higher frequency components beginning at $6F_p$-15=99 KHz. Accordingly, still another interpolation and digital filtering step 564 is performed in the microprocessor as represented in FIG. 11, namely "Interpolate 2:1, and Filter Out 8Fp−(2Fp+15 KHz) and Above". This step is also represented in FIG. 9G, wherein the desired components passed by the digital filtering are shown beneath the heavy broken lines at the left; undesired higher-frequency components are also passed, as shown under the heavy broken line at the right of FIG. 9G.

After the digital-to-analog conversion step as shown at 566 (provided by D/A converter 414 in FIG. 10), the resultant signal is low-pass filtered in step 568 of FIG. 11, by means of the analog LPF 468 in FIG. 10, to select the 0–53 KHz components and reject the higher components. Such an analog low-pass filter which will pass up to 53 KHz with linear phase yet reject all components above 10 $F_p$+15 KHz is within the skill of the art. The output of filter 468 therefore provides the desired regenerated composite stereo for delivery to the FM transmitter of FIG. 5B.

Not mentioned in the foregoing is the step 560 of FIG. 11, namely "D/A Equalize". This is a known step used to compensate for the fact that the D/A conversion step 566 typically produce an effective frequency passband which attenuates higher frequency components near the sampling frequency $F_s$, as shown in the plot of D/A attenuation versus frequency in FIG. 9F for a typical D/A converter. To compensate for the frequency characteristic, of the D/A converter, the equaling step 560 is performed in the microprocessor to modify the signal amplitudes in accordance with the equalizing characteristic shown in broken line in FIG. 9G, which rises oppositely to the fall-off of amplitude due to the D/A conversion in the frequency band of interest, thereby neutralizing the attenuation due to the D/A converter as desired to maintain the proper relationship between the frequency components of the regenerated composite stereo signal.

While the invention has been described with reference to specific embodiments in the interest of complete definiteness, it will be understood that it may be embodied in a variety of forms diverse from those specifically shown and described, without departing from the spirit and scope of the invention.

What is claimed is:

1. A system for conveying from one location to another location a standard composite stereo signal of the type containing a baseband of frequency components representing the sum (L+R) of the Left and Right stereo signals L and R; a suppressed subcarrier signal modulated with a signal representing the difference (L−R) between the Left and Right signals and comprising frequency components above the highest frequency in said baseband, and a pilot carrier at a frequency between the highest frequency in said baseband and the lowest frequency in said modulated subcarrier signal, synchronized in phase and frequency with said subcarrier, said system comprising:

sampling means at said first location responsive to said composite stereo signal for sampling it at the phase of the positive and negative peaks of said subcarrier;

means for transmitting the samples resulting from said sampling, from said first location to said second location;

at said second location, means for processing said samples to derive therefrom signals representative of L, signals representative of R, and pilot carrier signals of the same frequency and relative level as said transmitted pilot carrier signal, and means for combining said derived L-representing signals, said derived R-representing signals and said derived pilot carrier signals for combining them to regenerate said standard composite stereo signal.

2. Apparatus for sending from a first location to a second location a composite stereo signal, which signal comprises (a) a base band signal (L+R) representing the sum of a signal L representing a first stereo signal component and a signal R representing a second stereo signal component, said base band signal (L+R) being limited to a low-frequency band of 0 to $F_{L+R}$, (b) a suppressed subcarrier signal having sidebands about a subcarrier frequency $F_c$ which represent a value proportional to the difference (L−R) between said signals L and R, said subcarrier frequency $F_c$ being at least as great as twice said base band upper frequency limit $F_{L+R}$, and (c) a pilot carrier at a frequency $F_p$ equal to one-half $F_c$ and in phase and frequency synchronism with said subcarrier, said subcarrier signal representing L when at one of its extreme values and representing R when at the other of its extreme values, said apparatus comprising:

means for producing samples of said composite stereo signal at a sample rate $F_s$ equal to twice said subcarrier frequency $F_c$ and in a phase such that one set of alternate resultant samples represent said signal values L plus the contemporaneous values of said pilot carrier, while other alternate resultant samples represent said values R plus the contemporaneous values of said pilot carrier; and transmission means for transmitting said samples and said pilot carrier from said first location to said second location.

3. The apparatus of claim 2, wherein said sampling is performed at the successive positive and negative peaks of said subcarrier signal.

4. The apparatus of claim 2, wherein said sampling means comprises phase-locked loop means supplied with said pilot carrier from said composite stereo signal for generating a sampling control signal at said frequency $F_c$ locked in phase and frequency synchronism with said pilot carrier.

5. The apparatus of claim 2, comprising means at said first location for generating a digital synchronizing signal identifying the times of occurrence of samples representing L and of samples representing R, and means for forming a common bit stream containing bits representing the values of said samples interspersed with bits representing said synchronizing signals.

6. The apparatus of claim 2, wherein said tranmission means comprises a wire line.

7. The apparatus of claim 5, comprising receiver means at said second location for receiving said common bit stream and for separating from it said synchronizing signals, said L-representing samples, said R representing samples and said pilot carrier, and signal regenerating means responsive to said separated L-representing samples, said separated R-representing samples and said separated pilot carrier to form a reconstituted composite stereo signal substantially identical with said composite stereo signal at said first location.

8. The method of transmitting, from a first location to a second location, an original composite stereo signal, which signal comprises (a) an original low-frequency band of frequency components representing the sum (L+R) of the instantaneous amplitude value L of a first stereo channel signal and the instantaneous amplitude value R of a second stereo channel; (b) an original double-side band suppressed carrier signal containing sidebands about a suppressed subcarrier frequency $F_c$ and representing the difference (L−R) between said value L and said value R; and (c) an original pilot carrier P at a frequency $F_p$ intermediate the upper frequency limit of said low-frequency band and the lower frequency limit of said original double-sideband; said method comprising the following steps:

at said first location, sampling said original composite stereo signal at a sampling frequency $F_s$ substantially equal to twice the frequency of said suppresed subcarrier, and at successive phases for which said original composite stereo signal represents alternately said value L of said first stereo channel signal plus the contemporaneous amplitude value of said pilot carrier, and the value R of said second stereo channel plus the contemporaneous amplitude value of said pilot carrier;

at said first location, forming a serial-bit digital data signal in which said samples are represented by predetermined sets of bits in predetermined positions in said serial serial-bit digital data signal, forming a serial-bit synchronizing signal indicative of which of said sets of sample-representing sets represent which samples, and combining said serial-bit synchronizing signal with said serial-bit digital data signal in a common bit stream for transmission from said first location to said second location;

at said second location, receiving said common serial bit stream and deriving therefrom a first decoded signal $L_n$ representative of said value L, a second decoded signal $R_n$ representative of said value R, and a decoded signal $P_n$ representative of said pilot carrier signal; and combining said decoded signals $L_n$, $R_n$ and $P_n$ in a manner and in proportions to produce a regenerated composite stereo signal substantially identical to said original composite stereo signal.

9. The method of claim 10, wherein said pilot carrier frequency $F_p$ is one-half said subcarrier frequency $F_c$; said sampling is accomplished in response to a sampling signal at said frequency $F_s$ which is phase and frequency locked with said pilot carrier; and said synchronizing signal comprises sets of bits each set indicating the occurrence of a frame of said samples.

10. The method of claim 10, in which said common bit stream is transmitted from said first location to said second location over a wire line.

11. The method of claim 10, wherein said deriving of said signals Ln, Rn and Pn comprises detecting the occurrences of said synchronizing signals, and separating those samples in said received common bit stream representative of Ln from those representative of Rn in response to said detected synchronizing signals.

12. The method of claim 11, comprising interpolating artificial sample values between said separated samples of Ln and Rn.

13. Apparatus for sending from a first station to a second station signals representing a composite stereo sound signal, which signal comprises: a baseband signal component (L+R) representing the sum of a signal L representing a first stereo channel signal and a signal R representing the other stereo signal channel, said baseband component signal comprising frequency components in a frequency band O-$F_{L+R}$; a suppressed-sub-carrier signal comprising upper and lower amplitude-modulation sidebands extending above and below the frequency $F_c$ of said subextend carrier and representing the differences (L−R) between said signals L and R, said sub-carrier frequency $F_c$ being at least twice said frequency $F_{L+R}$; and a pilot carrier at a frequency $F_p$ of about $\frac{1}{2}$ $F_c$, in phase and frequency lock with said sub-carrier; whereby one extreme of said composite stereo sound signal represents the value of said signal L and the other extreme of said stereo sound signal represents the value of said signal R; said apparatus comprising:

sampling means, at said first station, responsive to said composite stereo sound signal for sampling said composite stereo sound signal at a frequency $F_s$ equal to $2F_c$, at those successive times at which said sub-carrier signal represents said signal L and at those successive other times at which it represents said signal R and means for transmitting the samples produced by said sampling means to said second station.

* * * * *